US011642568B2

(12) United States Patent
Chan et al.

(10) Patent No.: US 11,642,568 B2
(45) Date of Patent: May 9, 2023

(54) LIMB EXERCISE MACHINE

(71) Applicant: Cheng Yu Chan, Changhua County (TW)

(72) Inventors: Cheng Yu Chan, Changhua County (TW); Chueh Hao Chan, Changhua County (TW)

(73) Assignee: Cheng Yu Chan, Changhua County (TW)

( * ) Notice: Subject to any disclaimer, the term of this patent is extended or adjusted under 35 U.S.C. 154(b) by 100 days.

(21) Appl. No.: 17/477,203

(22) Filed: Sep. 16, 2021

(65) Prior Publication Data

US 2023/0084138 A1 Mar. 16, 2023

(51) Int. Cl.

*A63B 22/00* (2006.01)
*A63B 22/06* (2006.01)
*A63B 22/20* (2006.01)

(52) U.S. Cl.

CPC ..... *A63B 22/0664* (2013.01); *A63B 22/0025* (2015.10); *A63B 22/203* (2013.01)

(58) Field of Classification Search

CPC ..... A63B 22/0664; A63B 22/0025; A63B 22/203

See application file for complete search history.

(56) References Cited

U.S. PATENT DOCUMENTS 7,998,043 B2 * 8/2011 Zhou ..... A63B 22/001 482/139
2005/0049117 A1 * 3/2005 Rodgers ..... A63B 22/0664 482/52
2020/0171346 A1 * 6/2020 Chen ..... A63B 22/205

FOREIGN PATENT DOCUMENTS

TW I618559 B 3/2018

* cited by examiner

*Primary Examiner* — Sundhara M Ganesan
*Assistant Examiner* — Jacqueline N L Loberiza
(74) *Attorney, Agent, or Firm* — Muncy, Geissler, Olds & Lowe, P.C.

(57) ABSTRACT

A limb exercise machine includes a first transmission unit and a second transmission unit. A left-hand control member, as well as a right-foot control member, is connected to the first transmission unit. The left-hand control member and the right-foot control member are pulled by the first transmission unit to be moved synchronously. A right-hand control member, as well as a left-foot control member, is connected to the second transmission unit. The right-hand control member and the left-foot control member are pulled by the second transmission unit to be moved synchronously.

5 Claims, 5 Drawing Sheets

LIMB EXERCISE MACHINE

FIELD OF THE INVENTION

The present invention relates to an exercise machine, and more particularly to a limb exercise machine for exercising the upper and lower limbs of a user synchronously.

BACKGROUND OF THE INVENTION

In these days, people pay more attention to do exercise, so there are various exercise machines on the market. Taiwan Patent Publication No. I618559A discloses a vertical climbing machine for doing exercise by stepping continuously. The user steps on the pedals with both feet and performs the action of stepping repeatedly. The two pedals of the above-mentioned conventional structure are respectively connected with handles above the pedals, so that the handles are linked with the pedals. When the pedals are stepped down, the handles are driven synchronously, and the user's hands resting on the handles are pulled to swing for the user to exercise his/her upper and lower limbs.

In the above-mentioned conventional structure, the right-foot pedal is connected to the right-hand handle, and the left-foot pedal is connected to the left-hand handle. When the right-foot pedal is stepped down by the user's right foot, the right hand is synchronously pulled down to swing; on the other hand, when the left-foot pedal is stepped down by the user's left foot, the left hand is synchronously pulled down to swing. Accordingly, this conventional structure enables the user to exercise the left upper and lower limbs and the right upper and lower limbs by turns. It is not in line with human kinesiology. As a result, the motion is not coordinated, and it is unable to provide a better exercise effect.

SUMMARY OF THE INVENTION

The primary object of the present invention is to provide a limb exercise machine. The user's upper and lower limbs are pulled to perform staggered swings. It is in line with human kinesiology, which makes the movement more coordinated and smooth and enhances the effect of doing exercise.

In order to achieve the foregoing object, the present invention provides a limb exercise machine, comprising a base, a first transmission unit, a second transmission unit, and a resistance device.

The base includes a first step portion, a second step portion and a third step portion in a descending order of height. An upper left slide rail and an upper right slide rail are connected between the first step portion and the second step portion and extend obliquely. A lower left slide rail and a lower right slide rail are connected between the second step portion and the third step portion and extend obliquely.

One end of the first transmission unit is connected to a left-hand control member for manipulation of a user's left hand. Another end of the first transmission unit is connected to a right-foot control member for manipulation of the user's right foot. The left-hand control member is slidably disposed on the upper left slide rail. The right-foot control member is slidably disposed on the lower right slide rail. The left-hand control member and the right-foot control member are pulled by the first transmission unit to be moved synchronously.

One end of the second transmission unit is connected to a right-hand control member for manipulation of the user's right hand. Another end of the second transmission unit is connected to a left-foot control member for manipulation of the user's left foot. The right-hand control member is slidably disposed on the upper right slide rail. The left-foot control member is slidably disposed on the lower left slide rail. The right-hand control member and the left-foot control member are pulled by the second transmission unit to be moved synchronously.

The resistance device is connected to the left-foot control member and the right-foot control member to provide a resistance when moving.

Preferably, the first transmission unit includes an upper left link connected to the left-hand control member and a lower right link connected to the right-foot control member. The upper left link and the lower right lower link are fixedly connected by a first transverse rod. The second transmission unit includes an upper right link connected to the right-hand control member and a lower left link connected to the left-foot control member. The upper right link and the lower left link are fixedly connected by a second transverse rod.

Preferably, each of the left-hand control member, the right-hand control member, the left-foot control member and the right-foot control member is provided with a roller frame resting on the corresponding slide rail.

In an embodiment, the base is provided with a first pulley unit and a second pulley unit. The first pulley unit includes a first pull rope connected to the left-hand control member and the right-hand control member. The left-hand control member and the right-hand control member are pulled by the first pull rope to move synchronously. The second pulley unit includes a second pull rope connected to the left-foot control member and the right-foot control member. The left-foot control member and the right-foot control member are pulled by the second pull rope to move synchronously.

Preferably, the resistance device includes two pneumatic cylinder units connected to the left-foot control member and the right-foot control member, respectively.

Preferably, the resistance device includes four springs. Two of the springs are connected to the left-foot control member, and the other two of the springs are connected to the right-foot control member.

DETAILED DESCRIPTION OF THE PREFERRED EMBODIMENTS

Embodiments of the present invention will now be described, by way of example only, with reference to the accompanying drawings.

Figure 1:
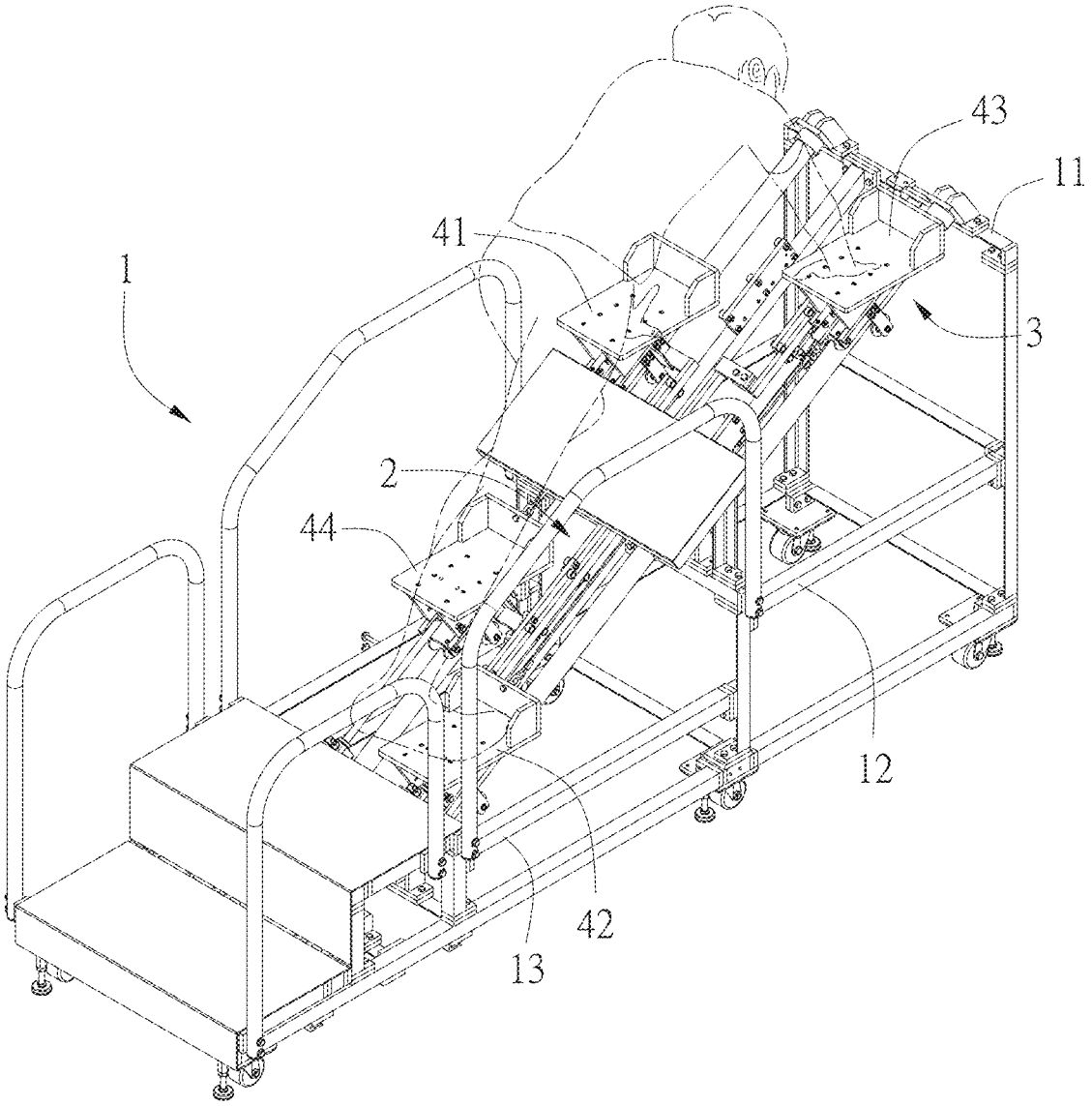
FIG. 1 is a perspective schematic view of the present invention.
Figure 2:
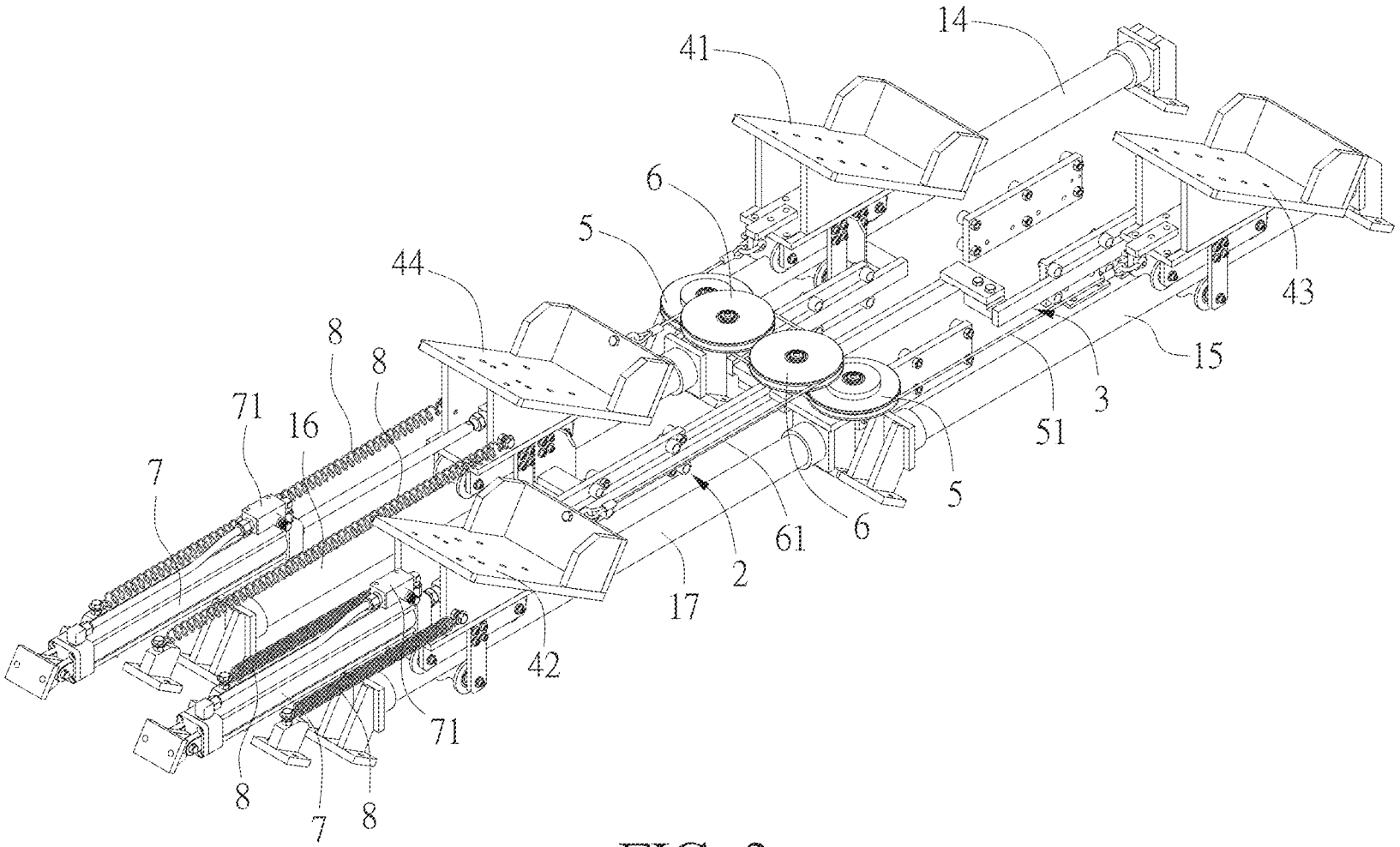
FIG. 2 is a schematic view of the partial components of the present invention, without the base.

As shown in FIG. 1 and FIG. 2, a limb exercise machine provided by the present invention comprises a base 1, a first transmission unit 2, a second transmission unit 3, and a resistance device. The base 1 is a stepped frame, having a first step portion 11, a second step portion 12 and a third step portion 13 in a descending order of height. The first step portion 11 is connected with an upper left slide rail 14 and an upper right slide rail 15. The other end of each of the upper left slide rail 14 and the upper right slide rail 15 is connected to the second step portion 12. The second step portion 12 is connected with a lower left slide rail 16 and a lower right slide rail 17. The other end of each of the lower left slide rail 15 and the lower right slide rail 17 is connected to the third step portion 13. Because the first step portion 11, the second step portion 12 and the third step portion 13 have a difference in height, the slide rails each extend in an oblique manner.

Figure 3:
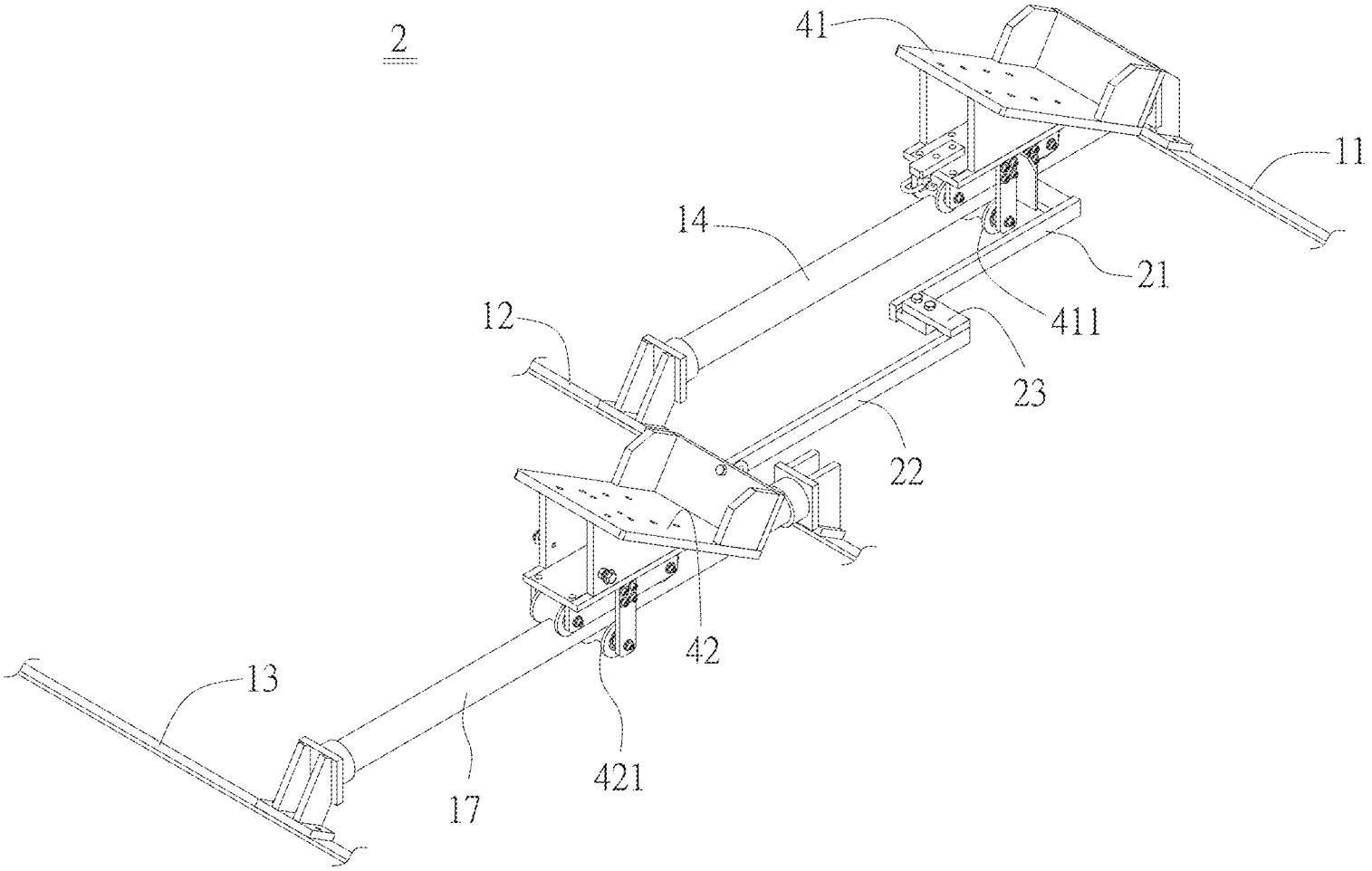
FIG. 3 is a schematic view of the partial components of the present invention, only illustrating the first transmission unit.

As shown in FIG. 3, the first transmission unit 2 includes an upper left link 21 and a lower right link 22. The upper left link 21 and the lower right lower link 22 are fixedly connected by a first transverse rod 23. The upper left link 21 is connected with a left-hand control member 41 for manipulation of the user's left hand. The bottom of the left-hand control member 41 is provided with a roller frame 411 resting on the upper left slide rail 14, so that the left-hand control member 41 can slide along the upper left slide rail 14. The lower right link 22 is connected with a right-foot control member 42 for manipulation of the user's right foot. The bottom of the right-foot control member 42 is provided with a roller frame 421 resting on the lower right slide rail 17, so that the right-foot control member 42 can slide along the lower right slide rail 17. The left-hand control member 41 and the right-foot control member 42 can be pulled by the first transmission unit 2 to be moved synchronously. Based on the arrangement of the first transverse rod 23, the left-hand control member 41 and the right-foot control member 42 are spaced a determined distance apart from each other in the transverse direction to correspond in position to the left hand and the right foot of the human body, respectively.

Figure 4:
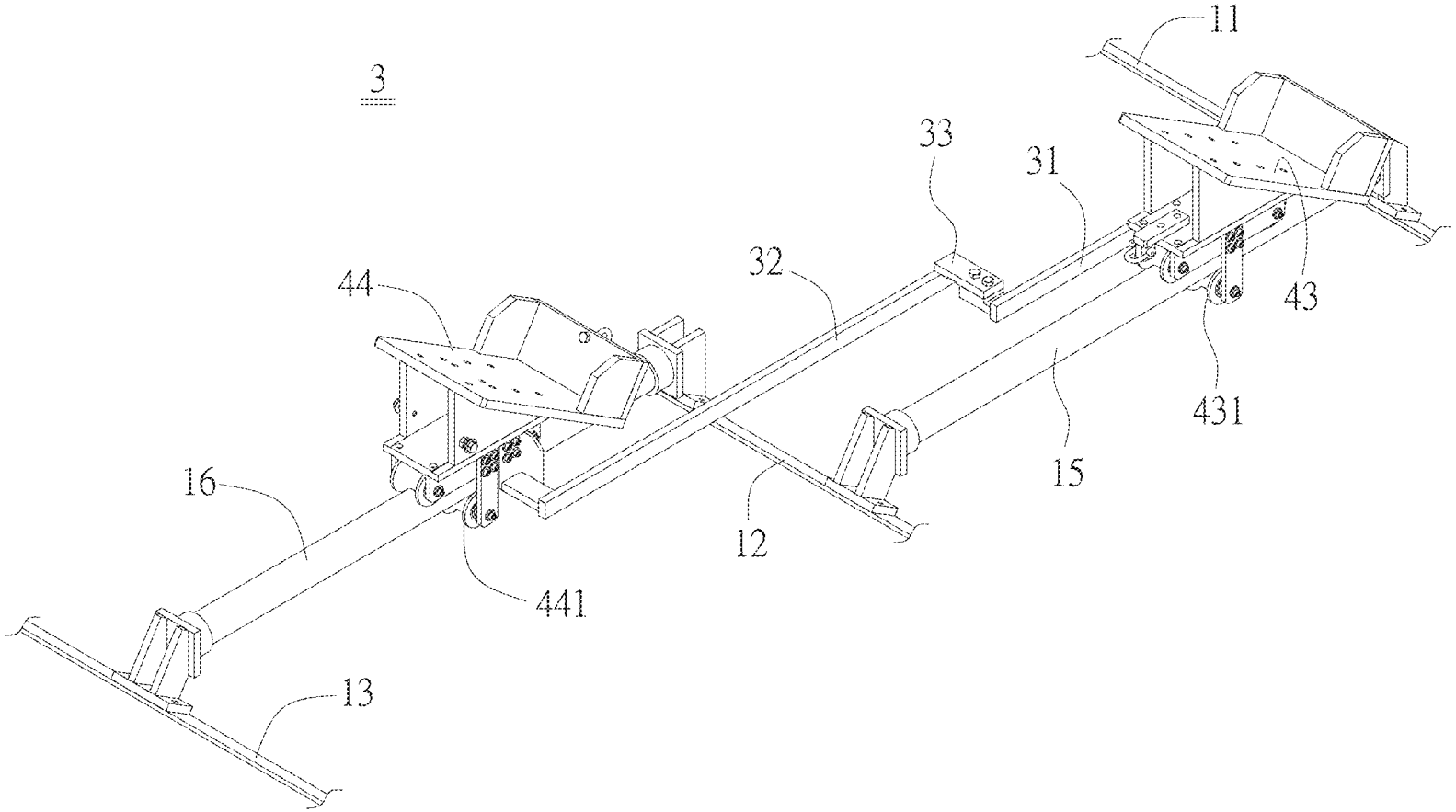
FIG. 4 is a schematic view of the partial components of the present invention, only illustrating the second transmission unit.

As shown in FIG. 4, the second transmission unit 3 includes an upper right link 31 and a lower left link 32. The upper right link 31 and the lower left link 32 are fixedly connected by a second transverse rod 33. The upper right link 31 is connected with a right-hand control member 43 for manipulation of the user's right hand. The bottom of the right-hand control member 43 is provided with a roller frame 431 resting on the upper right slide rail 15, so that the right-hand control member 43 can slide along the upper right slide rail 15. The lower left link 32 is connected with a left-foot control member 44 for manipulation of the user's left foot. The bottom of the left-foot control member 44 is provided with a roller frame 441 resting on the lower left slide rail 16, so that the left-foot control member 44 can slide along the lower left slide rail 16. The right-hand control member 43 and the left-foot control member 44 can be pulled by the second transmission unit 3 to be moved synchronously. Based on the arrangement of the second transverse rod 33, the right-hand control member 43 and the left-foot control member 44 are spaced a determined distance apart from each other in the transverse direction to correspond in position to the right hand and the left foot of the human body, respectively.

In this embodiment, each of the left-hand control member 41, the right-hand control member 43, the left-foot control member 44 and the right-foot control member 42 is in the form of a plate, so that the user can put his/her corresponding hands and feet on the respective control members to do exercise. The control members are not limited to the above-mentioned structure. As long as they can be manipulated by the hands and feet of the user, they should belong to the scope of the present invention.

Furthermore, as shown in FIG. 2, the base 1 is provided with a first pulley unit 5. A first pull rope 51 passes around the first pulley unit 5. Two ends of the first pull rope 51 are connected to the left-hand control member 41 and the right-hand control member 43, respectively. Because the length of the first pull rope 51 is fixed, when one of the left-hand control member 41 and the right-hand control member 43 slides along the corresponding slide rail, the other will be pulled by the first pull rope 51 to move synchronously. The base 1 is provided with a second pulley unit 6. A second pull rope 61 passes around the second pulley unit 6. Two ends of the second pull rope 61 are connected to the left-foot control member 44 and the right-foot control member 42, respectively. Because the length of the second pull rope 61 is fixed, when one of the left-foot control member 44 and the right-foot control member 42 slides along the corresponding slide rail, the other will be pulled by the second pull rope 61 to move synchronously.

Figure 5:
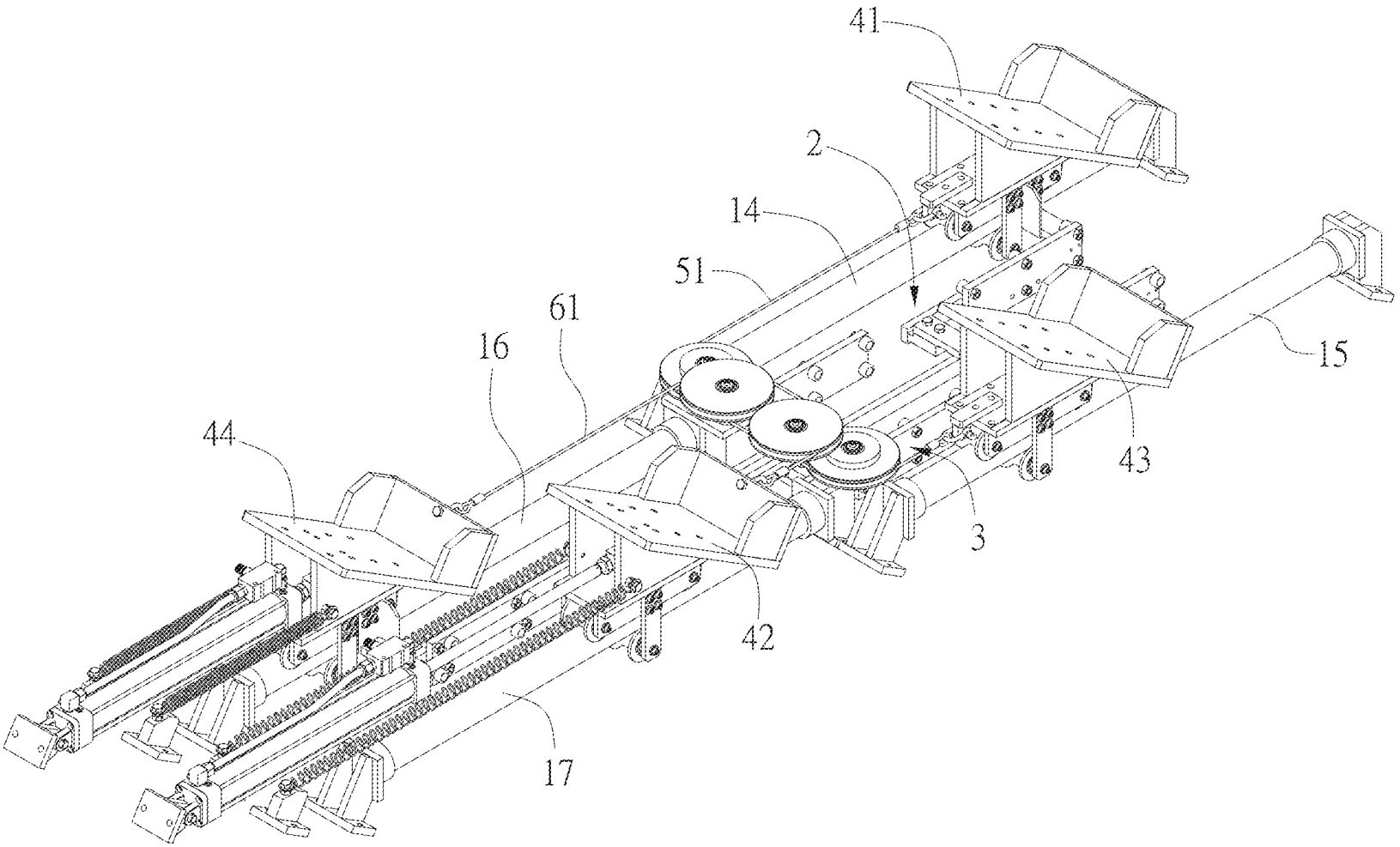
FIG. 5 is a schematic view of the present invention in an operating state.

With the above structure, the user can bend over the base 1 as shown in FIG. 1, with both hands and feet resting on the left-hand control member 41, the right-hand control member 43, the left-foot control member 44 and the right-foot control member 42 respectively to do exercise. In detail, as shown in FIG. 2, when the user steps down with his/her right foot, the right-foot control member 42 will move down along the lower right slide rail 17. Then, the left-hand control member 41 is pulled to move down synchronously through the first transmission unit 2, and the left-foot control member 44 is pulled to move up synchronously through the second pull rope 61. The left-foot control member 44 is pulled by the second transmission unit 3 to move the right-hand control member 43 up synchronously. On the other hand, as shown in FIG. 5, when the user steps down with his/her left foot, the left-foot control member 44 will move down along the lower left slide rail 16. Then, the right-hand control member 43 is pulled to move down synchronously through the first transmission unit 2, and the right-foot control member 42 is pulled to move up synchronously through the second pull rope 61. The right-foot control member 42 is pulled by the second transmission unit 3 to move the left-hand control member 41 up synchronously. Accordingly, the four control members guide the user's upper and lower limbs to do exercise, respectively.

The foregoing four control members further use a resistance device to increase the difficulty of driving, thereby enhancing the effect of doing exercise. In this embodiment, the resistance device includes two pneumatic cylinder units 7 respectively connected to the left-foot control member 44 and the right-foot control member 42 and four springs 8. Two of the springs are connected to the right-foot control member 42, and the other two of the springs are connected to the left-foot control member 44. The pneumatic cylinder unit 7 can adjust the exhaust flow in the cylinder through an exhaust throttle valve 71, and the spring 8 can be adjusted through the elastic coefficient to change the driving difficulty of each control member.

Based on the foregoing description and the drawings, it can be understood that when the right-foot control member 42 is stepped to move down, the left-hand control member 41 is moved down in coordination; when the left-foot control member 44 is stepped to move down, the right-hand control member 43 is moved down in coordination. Accordingly, the user's upper and lower limbs are pulled to perform staggered swings, just like the natural swinging motion of the human body when walking. It is in line with human kinesiology, which makes the movement more coordinated and smooth and enhances the effect of doing exercise.

What is claimed is:

1. A limb exercise machine, characterized in comprising:

a base, including a first step portion, a second step portion and a third step portion in a descending order of height, an upper left slide rail and an upper right slide rail being connected between the first step portion and the second step portion and extending obliquely, a lower left slide rail and a lower right slide rail being connected between the second step portion and the third step portion and extending obliquely;

a first transmission unit, one end of the first transmission unit being connected to a left-hand control member for manipulation of a user's left hand, another end of the first transmission unit being connected to a right-foot control member for manipulation of the user's right foot, the left-hand control member being slidably disposed on the upper left slide rail, the right-foot control member being slidably disposed on the lower right slide rail, the left-hand control member and the right-foot control member being pulled by the first transmission unit to be moved synchronously;

a second transmission unit, one end of the second transmission unit being connected to a right-hand control member for manipulation of the user's right hand, another end of the second transmission unit being connected to a left-foot control member for manipulation of the user's left foot, the right-hand control member being slidably disposed on the upper right slide rail, the left-foot control member being slidably disposed on the lower left slide rail, the right-hand control member and the left-foot control member being pulled by the second transmission unit to be moved synchronously;

a first pulley unit, including a first pull rope connected to the left-hand control member and the right-hand control member, the left-hand control member and the right-hand control member being pulled by the first pull rope to move synchronously;

a second pulley unit, including a second pull rope connected to the left-foot control member and the right-foot control member, the left-foot control member and the right-foot control member being pulled by the second pull rope to move synchronously;

a resistance device, connected to the left-foot control member and the right-foot control member to provide a resistance when moving.

2. The limb exercise machine as claimed in claim 1, wherein the first transmission unit includes an upper left link connected to the left-hand control member and a lower right link connected to the right-foot control member, the upper left link and the lower right lower link are fixedly connected by a first transverse rod; the second transmission unit includes an upper right link connected to the right-hand control member and a lower left link connected to the left-foot control member, the upper right link and the lower left link are fixedly connected by a second transverse rod.

3. The limb exercise machine as claimed in claim 1, wherein each of the left-hand control member, the right-hand control member, the left-foot control member and the right-foot control member is provided with a roller frame resting on the corresponding slide rail.

4. The limb exercise machine as claimed in claim 1, wherein the resistance device includes two pneumatic cylinder units connected to the left-foot control member and the right-foot control member, respectively.

5. The limb exercise machine as claimed in claim 1, wherein the resistance device includes four springs, two of the springs are connected to the left-foot control member, and the other two of the springs are connected to the right-foot control member.

* * * * *